US008839846B2

(12) United States Patent
Smith et al.

(10) Patent No.: US 8,839,846 B2
(45) Date of Patent: Sep. 23, 2014

(54) MECHANICAL JOINT FOR CUZNFE ALLOY HEAT EXCHANGER AND METHOD

(75) Inventors: Geoff Smith, Jackson, TN (US); Jay Korth, Kenosha, WI (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 1473 days.

(21) Appl. No.: 11/000,849

(22) Filed: Dec. 1, 2004

(65) Prior Publication Data

US 2005/0121184 A1 Jun. 9, 2005

Related U.S. Application Data

(60) Provisional application No. 60/527,432, filed on Dec. 5, 2003.

(51) Int. Cl.
*F28F 9/02* (2006.01)
*B21D 53/02* (2006.01)

(52) U.S. Cl.
USPC ..... 165/173; 29/890.03

(58) Field of Classification Search
USPC ..... 165/173; 29/890
See application file for complete search history.

(56) References Cited

U.S. PATENT DOCUMENTS

| | | | | | |
|---|---|---|---|---|---|
| 3,027,142 | A * | 3/1962 | Albers et al. | 165/151 |
| 3,710,473 | A * | 1/1973 | McElwain et al. | 29/890.038 |
| 3,857,151 | A * | 12/1974 | Young et al. | 29/890.047 |
| 4,142,581 | A * | 3/1979 | Yoshitomi et al. | 165/173 |
| 4,546,824 | A * | 10/1985 | Melnyk | 165/153 |
| 4,715,910 | A * | 12/1987 | Mandigo et al. | 148/414 |
| 4,730,669 | A * | 3/1988 | Beasley et al. | 165/151 |
| 4,744,505 | A * | 5/1988 | Calleson | 29/890.044 |
| 4,858,686 | A * | 8/1989 | Calleson | 165/173 |
| 4,922,622 | A * | 5/1990 | Galloway | 33/542 |
| 4,943,001 | A * | 7/1990 | Meyer | 228/173.4 |
| 5,099,575 | A * | 3/1992 | Colvin et al. | 29/890.044 |
| 5,343,620 | A * | 9/1994 | Velluet | 29/890.043 |
| 5,407,004 | A * | 4/1995 | DeRisi et al. | 165/153 |
| 5,992,198 | A * | 11/1999 | Blangetti et al. | 72/62 |
| 7,036,570 | B2 * | 5/2006 | Korth et al. | 165/173 |
| 2005/0005447 | A1 * | 1/2005 | Korth et al. | 29/890.044 |

OTHER PUBLICATIONS

International Copper Association, Cuprobraze Executive Report.*

* cited by examiner

*Primary Examiner* — Brandon M Rosati
(74) *Attorney, Agent, or Firm* — The Webb Law Firm

(57) ABSTRACT

A method of creating a flat-round tube-to-header joint in a CuproBraze™ heat exchanger wherein the flat-round tube-to-header joint is disposed between a tube and a header having a generally circular opening having a first predetermined diameter formed on a first side thereof for receiving one end of a tube, and provides at least one generally circular end having a second predetermined diameter on the tube to fit into the generally circular opening of in the header. The method further provides a predetermined temper on at least one generally circular end which is at least sufficient to enable cold working of at least one generally circular end to prevent premature failures of the flat-round tube-to-header joint. The flat-round tube-to-header joint is formed by inserting one end of the tube into the first side of the header and forming the flat-round tube-to-header joint between one end of the tube and the header.

20 Claims, 2 Drawing Sheets

MECHANICAL JOINT FOR CUZNFE ALLOY HEAT EXCHANGER AND METHOD

CROSS REFERENCE TO RELATED APPLICATION

This patent application is related to and claims benefit from provisional patent application Ser. No. 60/527,432 filed Dec. 5, 2003.

FIELD OF THE INVENTION

The present invention relates, in general, to heat transfer products using a CT or Serpentine fin style core, which include but are not limited to, radiators, shell and tube type heat exchangers, charge air coolers, oil coolers, and fuel coolers and, more particularly, the instant invention relates to a flat-round tube-to-header type joint used in a CuproBraze™ or CuZnFe alloy, heat exchanger.

BACKGROUND OF THE INVENTION

Currently CuproBraze™, or CuZnFe alloy heat exchangers use a brazed tube-to-header type joint. This joint, while being relatively strong, is prone to leaks after the initial brazing of the core if the process is not under precise control. Many variables can lead to leaks developing at the joint. These variables include poor tolerances in the header hole or tube geometry, poor paste application on the tube-to-header joint, poor heat profiles during brazing, as well as other factors.

The brazed tube-to-header joint is also prone to premature failure. The tube-to-header assemblies of Serpentine style radiators utilizing oblong tubes use a header with oblong openings that are typically the same shape as the tube, only slightly larger. The tube is bonded, non-mechanically, to this header using a brazing process. Such tube ends with an oblong cross-sectional shape will have a diameter in one direction greater than the diameter in another (usually perpendicular) direction, which is referred to herein as the "major diameter" and "minor diameter", respectively.

Creation of a tube-to-header assembly or joint is accomplished by affixing a plurality of tubes having oblong ends into a plurality of corresponding oblong openings of approximately equal cross section in the header. As shown in the prior art (e.g., U.S. Pat. No. 5,150,520 to DiRisi), the tubes are inserted into corresponding openings in the header wall whereupon the minor diameter of the tube end is reduced and the major diameter of the tube end is increased to create a contacting fit around the circumference of the header.

Each tube is non-mechanically bonded to a corresponding collar opening in the header wall to form a plurality of tube-to-header joints. The collar openings are formed in the same operation when the plurality of openings are punched into the header.

Unfortunately, these prior art bonding processes add thermal stress to the tubes at their respective bonding locations, thereby increasing the grain size of the tube and reducing the tensile strength of the material at this point. A reduction in such tensile strength can and often times does result in pressure cycle fatigue and failure. This fatigue is also a result of the stresses applied during thermal cycling. Thermal cycling occurs during a cyclic change in coolant temperature, when idol coolant, initially at ambient temperature, becomes significantly hotter during use.

During the thermal cycle, deformation of the header may occur as a result of the weight of the heat exchanger and the coolants therein, thereby weakening the core-to-header assembly, which leads to failure of the bond. Furthermore, the addition of the secondary filler material, used to aid in strengthening the stressed tubes, can be a source for environmental concerns, such as the use of leaded solder for the secondary filler material.

SUMMARY OF THE INVENTION

In a first aspect, the present invention generally provides a process for the creation of a flat-round tube-to-header joint in a CuproBraze™ heat exchanger wherein the flat-round tube-to-header joint is disposed between a tube and a header having a generally circular opening, having a first predetermined diameter, formed on a first side thereof for receiving one end of a tube, and provides at least one generally circular end having a second predetermined diameter on the tube to fit into the generally circular opening formed in the header. The method further provides a predetermined temper on at least one generally circular end which is at least sufficient to enable cold working of the at least one generally circular end to prevent premature failures of the flat-round tube-to-header joint. The flat-round tube-to-header joint is formed by inserting one end of the tube into the first side of the header and forming the flat-round tube-to-header joint between one end of the tube and the header.

Another important aspect of this invention is to provide a flat-round joint in either a CT or Serpentine fin core by creating a bond between a coolant tube having an oblong cross-section and a header of a heat exchange device. One end of the coolant tube is shaped into a circular cross section. The circular end of the tube is inserted into a circular opening on the header and a bond is formed between the circular tube end and the header. The circular end of the tube is inserted into the opening formed in the header member until it extends at least through a thickness of the header. Preferably, the end of the tube extends so as to be approximately flush with a second side of the header opposite the first side of the header. The method includes the additional step of removing any excess portion of the tube which extends above a second side of the header member. An internal sizing tool can be inserted into the end of the coolant tube to shape the tube into a circular cross-section. The internal sizing tool has a generally circular cross section. The shaping of the end of the tube can also include shaping the outer surface with an external sizing tool having a generally hollow circular cross-section. Threads can be formed in a surface of each of the openings formed in the header member. The openings can be in a staggered arrangement or in substantially parallel rows.

Yet another significant aspect of this invention is to provide an improved flat-round joint in combination with a coolant tube having an oblong cross-section and a header in a heat transfer device having either a CT or a Serpentine fin core.

OBJECTS OF THE INVENTION

It is, therefore, one of the primary objects of the present invention to provide a flat-round tube-to-header joint in a CuproBraze™ heat exchanger which will substantially overcome the shortcomings of prior art tube-to-header assemblies as described above.

Another object, of the present invention, is to provide a flat-round tube-to-header joint in a CuproBraze™ heat exchanger which eliminates the brazed tube-to-header joint in a CuproBraze™ heat exchanger.

Still another object, of the present invention, is to provide a flat-round tube-to-header joint in a CuproBraze™ heat exchanger which significantly reduces premature failures of such flat-round tube-to-header joints.

Yet another object, of the present invention, is to provide a flat-round tube-to-header joint in a CuproBraze™ heat exchanger that reduces the row pitch in both the staggered and parallel style arrays.

An additional object, of the present invention, is to provide a mechanical bond between a coolant tube having an oblong cross section and a header in a CuproBraze™ heat exchanger.

A still further object, of the present invention, is to provide a flat-round tube-to-header joint in a CuproBraze™ heat exchanger that allows for easier repair of a leaking tube-to-header joint.

In addition to the above-described objects and advantages of the present invention, various other objects and advantages of such invention will become more readily apparent to those persons who are skilled in the same and related arts from the following more detailed description on the invention, particularly, when such description is taken in conjunction with the appended claims.

DETAILED DESCRIPTION OF THE PREFERRED EMBODIMENT

The present invention provides a method of creating a flat-round tube-to-header joint in a CuproBraze™ heat exchanger. Although the flat-round process is not currently being used in the CuproBraze™ process today, it is being used in the manufacturing process of traditional soldered plate-fin type radiators. For example, U.S. Pat. No. 3,857,151 describes the original process of making the flat-round joint and this process has been refined and copied by multiple manufacturers since its initial inception.

The applicants of the present invention have developed the means to modify and use this process on CuproBraze™ heat exchangers successfully. The modified process is slightly different when compared to soldered radiators because of a different brass material that is used for the tubes. The CuproBraze™ tube brass is a special anneal resistant alloy that does not anneal as much as traditional brass during the brazing process.

The ends 13 of the tubes 12, as shown in FIGS. 2A-2B and FIGS. 3A-3B used in the process of the presently preferred embodiment of the invention must be at the right temper for the flat-round process to work properly, otherwise premature failures may occur because of the cold working process of transforming the tube from the flat shape to the round shape and rolling it into the header 30.

Figure 1:
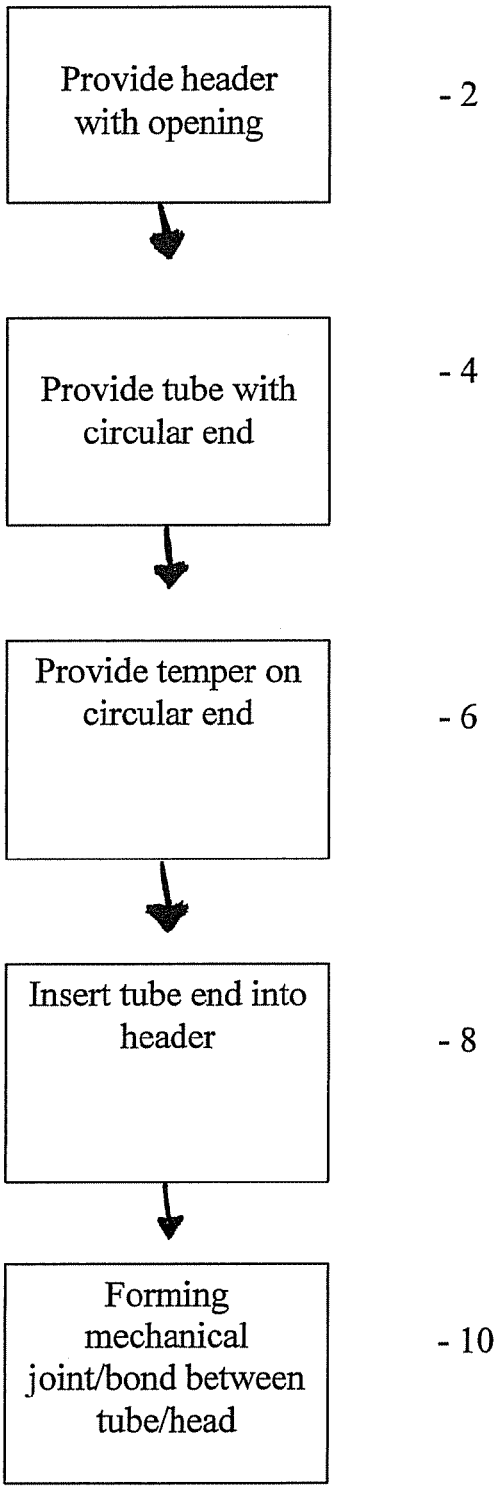
FIG. 1 shows a block diagram depicting the method steps of the present invention.
Figure 3B:
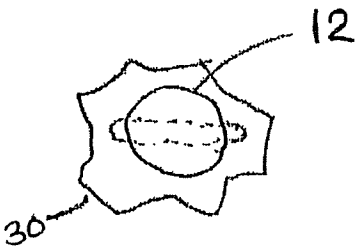
FIG. 3B is a top view of the end of the tube-to-header joint of FIG. 3A.
Figure 3A:
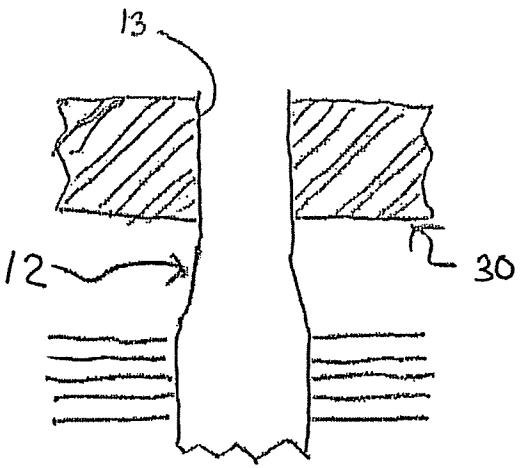
FIG. 3A is a cross-sectional side view of the tube-to-header joint.
Figure 2B:
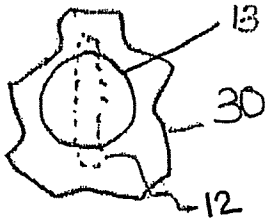
FIG. 2B is a top view of the end of the tube end of the tube-to-header joint of FIG. 2A.
Figure 2A:
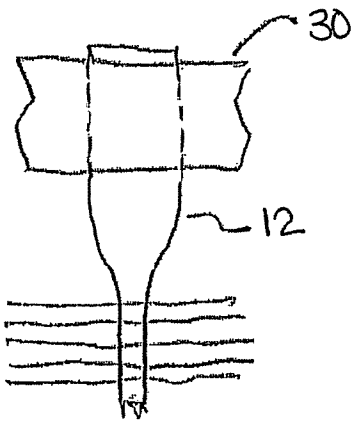
FIG. 2 A is a side view of the tube-to-header joint of the present invention.

As shown in the block diagram of FIG. 1, the method produces a flat-round tube-to-header joint in a CuproBraze™ heat exchanger. According to the method of the invention, a header having an opening is provided at 2, and a tube having a circular end is provided at 4. The flat-round tube-to-header joint is disposed between a tube and a header having a generally circular opening, having a first predetermined diameter, formed on a first side thereof for receiving one end of a tube, and also provides at least one generally circular end having a second predetermined diameter on the tube to fit into the generally circular opening of in the header.

The method further provides a predetermined temper at 6 on at least one generally circular end which is at least sufficient to enable cold working of such at least one generally circular end to prevent premature failures of the flat-round tube-to-header joint. The method further includes the steps of inserting the tube end into header at 8 and forming a mechanical joint/bond 10 between the tube and header.

As shown in FIGS. 2A-2B and FIGS. 3A-3B, the flat-round tube-to-header joint is formed by inserting one end 13 of the tube 12 into the first side of the header 30 and forming the flat-round tube-to-header joint between one end of the tube 13 and the header 30.

There are several advantages of the flat-round joint of the present invention. While the prior art header is restricted to a maximum thickness, the header of the presently preferred embodiment is thick enough to support the mechanical bond between the tubes circular end and the header. This thicker header reduces the deformation of the header when the tube-to-header assembly is in use.

Moreover, the added strength provided by the thicker header allows longer tubes to be used than in the prior art type tube-to-header assemblies thereby increasing the heat exchange capability of, for example, a heat exchanger.

The flat-round joint of the preferred embodiment forms a stronger bond than the prior art bond, and therefore makes it less sensitive to operational pressure cycle heat, and therefore has fewer failures than the prior art bonds. Also, the mechanical bonding process described above for the presently preferred embodiment may utilize an adhesive, but it does not subject the tubes to heat as in the prior art bonding process, and therefore does not increase the grain size of the tube or reduce the tensile strength of the material in the tubes in the header when the bond is made. Finally, the mechanical bond does not raise environmental concerns when the tube-to-header bond is made since a secondary filler material is not used.

While the present invention has been described by way of a detailed description of a particularly preferred embodiment, it will be readily apparent to those of ordinary skill in the art that various substitutions of equivalents may be affected without departing from the spirit or scope of the invention set forth in the appended claims.

We claim:

1. A method for producing a flat-round tube-to-header joint in a CuZnFe alloy heat exchanger, said flat-round tube-to-header joint disposed between a tube and a header having a generally circular opening having a first predetermined diameter formed on a first side thereof for receiving one end of said tube, said header having a second side located at an opposite side from said first side, said method comprising:

a) providing at least one generally circular end having a second predetermined diameter on said tube to fit into said generally circular opening of said header;

b) providing a predetermined temper on said at least one generally circular end which is at least sufficient to enable cold working of said at least one generally circular end to prevent premature failures of said flat-round tube-to-header joint;

c) inserting said one end of said tube into said first side of said header until it extends at least through a thickness of said header member;

d) removing any excess portion of said tube which extends above said second side of said header member so that said generally circular end of said tube is approximately flush with said second side of said header; and e) mechanically rolling said one end of said tube to form said flat-round tube-to-header joint between said one end of said tube and said header, wherein said header has a thickness that is capable of supporting the mechanical joint between the header and the circular end of the tube so as to reduce deformation of the header during use.

2. The method of claim 1 wherein said tube is a coolant tube having a generally oblong cross section.

3. The method of claim 1 wherein said header contains a plurality of generally circular openings.

4. The method of claim 1 wherein said heat exchanger includes one of a CT and a Serpentine fin core.

5. A method for forming a bond between a coolant tube having a generally oblong cross-section and a header member of a CuZnFe alloy heat exchanger, said header member having a predetermined plurality of generally circular openings, having a first predetermined diameter, formed on a first side thereof in one of a CT and a Serpentine fin configuration, said header member having a second side located at an opposite side from said first side, said method comprising:

a) shaping one end of said tube to change said generally oblong cross-section of said tube at said one end into a generally circular cross section having a second predetermined diameter;

b) inserting said one end of said tube into one of said predetermined plurality of generally circular openings formed in said header member on a first side thereof until it extends at least through a thickness of said header member so as to be approximately flush with said second side of said header member; and c) forming a mechanical bond between said one end of said tube and said header member by rolling to mechanically expand said tube end into said header, wherein said header member has a thickness that is capable of supporting the mechanical bond between the header member and the circular end of the tube so as to reduce deformation of the header member during use.

6. The method of claim 5 wherein said method of forming said bond includes the step of adding an adhesive between said tube and said header prior to mechanically rolling said tube into said generally circular opening in said header member.

7. The method of claim 5 wherein said method includes the additional step of removing any excess portion of said tube which extends above said second side of said header member after subparagraph (c).

8. A method for forming a bond between a coolant tube having a generally oblong cross-section and a header member of a CuZnFe alloy heat exchanger, said header member having a predetermined plurality of generally circular openings, having a first predetermined diameter, formed on a first side thereof in one of a CT and a Serpentine fin configuration, said header having a second side located at an opposite side from said first side, said method comprising:

a) shaping one end of said tube to change said generally oblong cross-section of said tube at said one end into a generally circular cross-section having a second predetermined diameter wherein said shaping includes inserting an internal sizing tool having a generally circular cross-section into said one end of said tube and using an external sizing tool having a generally hollow circular cross section to shape an outer surface of said one end of said tube;

b) inserting said one end of said tube into one of said predetermined plurality of generally circular openings formed in said header member on a first side thereof; and c) forming a mechanical bond between said one end of said tube and said header member by rolling to mechanically expand said tube end into said header.

9. The method of claim 5 wherein said method includes the additional step of forming threads in a surface of each of said predetermined plurality of openings formed in said header member.

10. The method of claim 5 wherein said method further includes the step of forming said openings in said header member in a staggered arrangement.

11. The method of claim 5 wherein said method further includes the step of forming said openings in said header member in substantially parallel rows.

12. The method of claim 5 wherein said first predetermined diameter is slightly larger than said second predetermined diameter.

13. The method of claim 5 wherein subparagraph (a) includes using an adhesive in forming said bond.

14. In combination with a coolant tube formed from a CuZnFe alloy having a generally oblong cross-section and a header member in a heat transfer device having one of a CT and a Serpentine fin configuration, the improvement comprising:

a) one end of said coolant tube having a generally circular cross section having a first diameter;

b) a circular opening in a first side of said header having a second diameter through which said generally circular end of said tube extends so as to be approximately flush with a second side of said header opposite said first side; and c) a mechanical attachment between said tube and said header formed by mechanically rolling said tube into said header, wherein said header has a thickness that is capable of supporting the mechanical attachment between the header and the end of the tube so as to reduce deformation of the header during use.

15. The combination of claim 14 wherein said opening is one of a plurality of openings arranged in substantially parallel rows.

16. The combination of claim 14 wherein said opening further is one of a plurality of openings arranged in staggered rows.

17. The combination of claim 14 wherein said mechanical attachment includes the addition of an adhesive.

18. The method of claim 1 wherein the header thickness is capable of supporting a tube having an extended length.

19. A method for forming a bond between a coolant tube having a generally oblong cross-section and a header member of a CuZnFe alloy heat exchanger, said header member having a predetermined plurality of generally circular openings, having a first predetermined diameter, formed therein in one of a CT and a Serpentine fin configuration, said method comprising:

a) shaping one end of said tube to change said generally oblong cross-section of said tube at said one end into a generally circular cross-section having a second predetermined diameter wherein said shaping includes inserting an internal sizing tool having a generally circular cross-section into said one end of said tube and shaping an outer surface of said one end of said tube with an external sizing tool having a generally hollow circular cross section;

b) inserting said one end of said tube into one of said predetermined plurality of generally circular openings formed in said header member on a first side such that said one end of said tube extends so as to be approximately flush with a second side of said header opposite said first side thereof; and c) forming a mechanical bond between said one end of said tube and said header member by rolling to mechanically expand said tube end into said header, wherein said header has a thickness that is capable of supporting the mechanical bond between the header and the end of the tube so as to reduce deformation of the header during use.

20. The method of claim 19 wherein the header thickness is capable of supporting a tube having an extended length.

* * * * *